US007056136B2

(12) United States Patent
Iwasaki

(10) Patent No.: US 7,056,136 B2
(45) Date of Patent: Jun. 6, 2006

(54) FLOATING CONNECTOR AND METHOD FOR MANUFACTURING THEREFOR

(75) Inventor: Masaaki Iwasaki, Kanagawa (JP)

(73) Assignee: Tyco Electronics.AMP K.K., Kanagawa-ken (JP)

( * ) Notice: Subject to any disclaimer, the term of this patent is extended or adjusted under 35 U.S.C. 154(b) by 0 days.

(21) Appl. No.: 10/864,928

(22) Filed: Jun. 10, 2004

(65) Prior Publication Data

US 2004/0253863 A1 Dec. 16, 2004

(30) Foreign Application Priority Data

Jun. 10, 2003 (JP) ..... 2003-165423

(51) Int. Cl.
*H01R 13/64* (2006.01)

(52) U.S. Cl. ..... 439/248

(58) Field of Classification Search ..... 439/248, 439/247

See application file for complete search history.

(56) References Cited

U.S. PATENT DOCUMENTS

| | | | | |
|---|---|---|---|---|
| 4,903,402 | A | 2/1990 | Norton et al. | 29/843 |
| 5,129,832 | A * | 7/1992 | Marsh et al. | 439/79 |
| 5,306,168 | A | 4/1994 | Kunishi et al. | 439/248 |
| 5,466,171 | A * | 11/1995 | Bixler et al. | 439/378 |
| 6,019,613 | A | 2/2000 | Kataoka et al. | 439/83 |
| 6,039,590 | A | 3/2000 | Kunishi | 439/247 |
| 6,132,222 | A | 10/2000 | Wang et al. | 439/70 |
| 6,431,906 | B1 * | 8/2002 | Belopolsky | 439/490 |
| 2001/0055915 | A1 | 12/2001 | Wang | 439/625 |
| 2002/0031931 | A1 | 3/2002 | Yokoyama et al. | 439/247 |

FOREIGN PATENT DOCUMENTS

| | | |
|---|---|---|
| EP | 0 702 429 A | 3/1996 |
| JP | 64-16084 | 1/1989 |
| JP | 04-370677 | 12/1992 |

OTHER PUBLICATIONS

Search Report prepared by the Austrian Patent Office for Singapore Application No. 200402431-1 dated Nov. 14, 2004.

European Search Report dated Sep. 2, 2004; app. No. EP 04 25 3468.

* cited by examiner

*Primary Examiner*—Javaid H. Nasri
(74) *Attorney, Agent, or Firm*—Barley Snyder LLC

(57) ABSTRACT

A floating connector comprises an insulating housing having a plurality of first and second contacts arranged in at least one row in the housing. Each of the first and second contacts has a contact member for contacting a mating contact, a leg for connecting to a first printed circuit board, and an elastic member disposed between the contact member and the leg. The elastic member has a curved shape and extends in a direction of the at least one row. A bent section is formed between the contact member and the leg. The bent section of the first contacts is shorter then the bent section of the second contacts so that the legs of the corresponding first and second contacts are arranged in a staggered configuration in the at least one row.

16 Claims, 9 Drawing Sheets

FLOATING CONNECTOR AND METHOD FOR MANUFACTURING THEREFOR

FIELD OF THE INVENTION

The invention relates to a floating connector and a method for manufacturing the same.

BACKGROUND OF THE INVENTION

To electrically connect two circuit boards to each other, an arrangement may be used in which a first connector is fastened to a first circuit board and a second connector is fastened to a second circuit board, and the first and second connectors are mated to electrically connect the first and second circuit boards. In this arrangement, however, there may be instances when the first and second connectors are fixed at a predetermined position on the first and second circuit boards, and therefore the first and second connectors do not precisely align during mating. As a result, when the first and second connectors are mated, unless one of the connectors is flexible, mating of the first and second connectors is difficult and at least one of the first and/or second connectors or contacts contained therein are susceptible to damage or permanent deformity. Damage to the first and/or second connectors and/or the contacts can result in a deficient electrical connection.

One way to solve this problem is to design either the first of second connector as a floating connector. A floating connector has a mating section formed so that the mating section is capable of moving elastically in at least a horizontal direction relative to a surface of the circuit board to which the floating connector is fixed. The floating connector thereby absorbs strain during mating.

FIGS. 7(A)–7(B) and 8(A)–8(C) show one example of a floating connector 101 (Japanese Utility Model Application Kokai No. S64-16084). As shown in FIGS. 7(A)–7(B), the floating connector 101 is fastened to a first printed circuit board PCB. The floating connector 101 is mated and connected with a mating connector 131. The mating connector 131 is fastened to a second printed circuit board PCB2 that is disposed perpendicular to the first circuit board PCB1. The mating connector 131 includes a housing 140 that extends in a direction of length (i.e., a direction perpendicular to a plane of the page in FIG. 7A or a left-right direction in FIG. 7B). A plurality of pin contacts 150 are attached in two rows in the direction of length of the housing 140. Each of the pin contacts 150 includes a board connection member that is connected by soldering to the second printed circuit board PCB2 and a pin contact member that extends vertically downward from the board connection part.

The floating connector 101 includes a housing 110 that extends in a direction of length (i.e., a direction perpendicular to a plane of the page in FIG. 7A or a left-right direction in FIG. 7B). A plurality of contacts 120 are attached in two rows in the direction of length of the housing 110. Each of the contacts 120 has a fastening member 121 fastened to the housing 110, a soldering tine member 123 connected to the first printed circuit board PCB1, and a pair of contact pieces 124 that contact the corresponding pin contact 150. The contacts 120 are formed by stamping and forming metal plates.

As best shown in FIGS. 8A–8C, the fastening member 121 is formed substantially in a box shape and has a pair of side walls 121*a* that are separated from each other by a specified interval in the direction of length of the housing 110. A front end wall 121*b* extends in the direction of length from the front end portion (lower end portion in FIG. 8C) of one side wall 121*a* to substantially a central portion between the pair of side walls 121*a*. A rear end wall 121*c* connects rear end portions of the pair of side walls 121*a*. A connecting member 122 extends rearward toward a center of the fastening member 121 perpendicular to the direction of length. The connecting member 122 is formed by being bent on an end of the front end wall 121*b* of the fastening member 121. A soldering tine member 123 extends downward from a rear end portion of the connecting member 122. The pair of contact pieces 124 extends upward from the respective side walls 121*a* of the fastening member 121. Contact projecting members 125 are formed on facing surfaces of end sections of the contact pieces 124.

The floating connector 101 is mounted on the first circuit board PCB1 by soldering the soldering tine members 123 of the contacts 120 to the first circuit board PCB1, as shown in FIGS. 7A–7B. When the mating connector 131 is mated with the floating connector 101, the pin contacts 150 contact the contact projecting members 125 of the contacts 120, so that an electrical connection is established between the floating connector 101 and the mating connector 131. As a result of the soldering tine members 123 extending downward from the connecting members 122, the floating connector 101 can move elastically in at least a horizontal direction (the direction of length of the housing 110 and the direction perpendicular to the direction of length) with respect to a surface of the first printed circuit board PCB1 such that strain created when mating the floating connector 101 with the mating connector 131 is absorbed.

The following problems have been encountered with the floating connector 101 shown in FIGS. 7A–7B and 8A–8C. Since the contacts 120 are formed by complicated forming following the stamping of metal plates, production of the contacts 120 is complicated and time consuming. Further, since the fastening members 121 of the contacts 120 are formed substantially with a box shape, the dimensions of the contacts 120 are relatively large in the direction of length of the housing 110 and the direction perpendicular to the direction of length, so that it is difficult to use the floating connector 101 in compact high-density electronic devices. Additionally, when the contacts 120 are fastened to the housing 110, the contacts 120 are not attached to the housing 110 all at one time, instead each of the contacts 120 is attached individually after being cut from a contact carrier. Accordingly, assembly of the floating connector 101 is time consuming.

Another example of a floating connector 201 is shown in FIG. 9 (Japanese Patent Application Kokai No. H4-370677). The floating connector 201 is devised such that strain created at the time of mating the floating connector 201 with a mating connector (not shown) is absorbed. As shown in FIG. 9, the floating connector 201 is fastened to a surface of a first printed circuit board (not shown) and is mated and connected with a mating connector (not shown) fastened to a second printed circuit board (not shown). The floating connector 201 includes a substantially frame-form first housing 210 that extends in a direction of length. A second housing 220 is inserted into an opening 211 in the first housing 210 so that a gap is left therebetween. A plurality of contacts 230 disposed in a single row in the direction of length is attached to the second housing 220. Each of the contacts 230 includes a fastening member 231 fastened to the second housing 220, a strain absorbing member 232, a board connection member 233 connected to the first printed circuit board (not shown), and a pair of contact members 234 that contact a mating contact (not shown).

The contacts 230 are formed in a substantially flat plate shape. The fastening member 231 is formed into a substantially rectangular shape formed exclusively by the stamping of a metal plate. The strain absorbing member 232 is formed into an elastic shape and extends from a lower end of the fastening member 231 via a plurality of curvilinear members. The strain absorbing member 232 is formed exclusively by stamping of the metal plate. The board connection member 233 is formed so that it extends downward from an end portion of the strain absorbing member 232 and is formed by stamping and forming of a metal plate. The pair of contact members 234 extends upward from the fastening member 231. Contact projecting members 235 are formed on facing surfaces of end sections of the contact members 234.

The floating connector 201 is mounted on the first printed circuit board (not shown) by connecting the board connection members 233 of the contacts 230 to the first circuit board (not shown) by soldering. When the mating connector (not shown) is mated with the floating connector 201, the mating contacts (not shown) contact the contact projecting members 235 of the contacts 230, so that an electrical connection is established between the floating connector 201 and the mating connector (not shown). In this state, the second housing 220 of the floating connector 201 is constructed so that the second housing 220 can move elastically in at least a horizontal direction (the direction of length of the second housing 220 and the direction perpendicular to the direction of length) as a result of the board connecting members 233 extending downward from the strain absorbing members 232 that are formed in an elastic shape with the plurality of curvilinear members. The strain that is generated when mating the floating connector 201 with the mating connector (not shown) is thereby absorbed.

The following problems have been encountered with the floating connector 201 shown in FIG. 9. Since the contacts 230 are formed exclusively by the stamping of metal plates, except for the base connection members 233, the contacts 230 can be made in an easy and timely manner. When the contacts 230 are fastened to the second housing 220, however, the contacts 230 can not be fastened all at one time. Because the planes of the strain absorbing members 232 and the base connection members 233 attached to the contact carrier in the state in which the metal plates have been stamped differ from the row disposition direction of the contacts 230 (a direction in which the contacts 230 are lined up in row form in the second housing 220, i.e., the direction of length of the second housing 220), each of the contacts 230 must be individually attached after being cut from a contact carrier. Accordingly, assembly of the floating connector 201 is time consuming. Additionally, although the contacts 230 are formed in a substantially flat plate shape such that the dimensions of each of the contacts 230 in the attachment pitch direction, i.e., the direction of length of the second housing 220, is small, the strain absorbing members 233 of each of the contacts 230 extends via a plurality of curvilinear members such that the contact 230 has a relatively large dimension in the direction perpendicular to the direction of length. Accordingly, it is difficult to use the floating connector 201 in compact high-density electronic devices.

SUMMARY OF THE INVENTION

It is therefore an object of the invention to provide a floating connector and a method of manufacturing the same which is superior in terms of contact productivity and connector assembly productivity and which allows for a compact high-density configuration.

This and other objects are achieved by a floating connector comprising an insulating housing having a plurality of first and second contacts arranged in at least one row in the housing. Each of the first and second contacts has a contact member for contacting a mating contact, a leg for connecting to a first printed circuit board, and an elastic member disposed between the contact member and the leg. The elastic member has a curved shape and extends in a direction of the at least one row. A bent section is formed between the contact member and the leg. The bent section of the first contacts is shorter then the bent section of the second contacts so that the legs of the corresponding first and second contacts are arranged in a staggered configuration in the at least one row.

This and other objects are further achieved by a method for manufacturing a floating connector. The method includes stamping a plurality of first and second contacts from a single metal plate. Each of the first and second contacts has a contact member for contacting a mating contact, a leg for connecting to a first printed circuit board, and an elastic member disposed between the contact member and the leg having a curved shape. The elastic members are shifted along an axial direction of the first and second contacts so that the elastic members of adjacent first and second contacts do not interfere with each other. A bent section is formed between the contact member and the leg. The bent section of the first contacts is formed shorter then the bent section of the second contacts so that the legs of the corresponding first and second contacts are arranged in a staggered configuration. The first and second contacts are then simultaneously inserted into a housing of the floating connector. End sections of the legs are cut to release the first and second contacts from a contact carrier.

DETAILED DESCRIPTION OF THE INVENTION

Figure 1A:
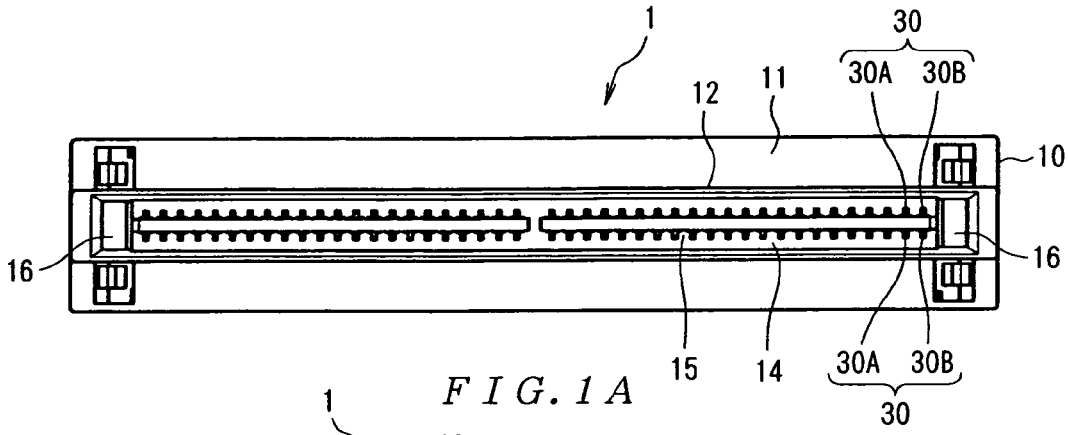
FIG. 1A is a plan view of a floating connector.
Figure 1B:
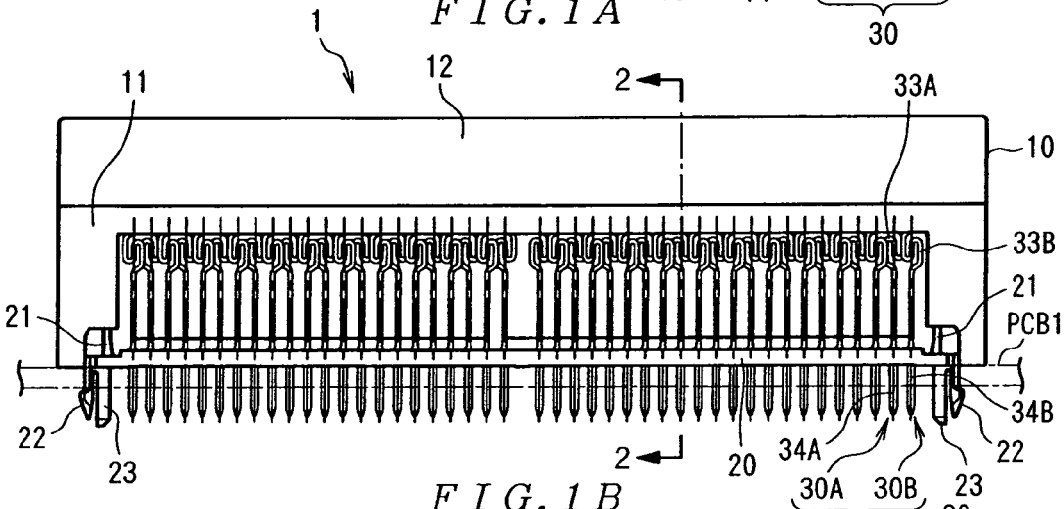
FIG. 1B is a front view of the floating connector.
Figure 1C:
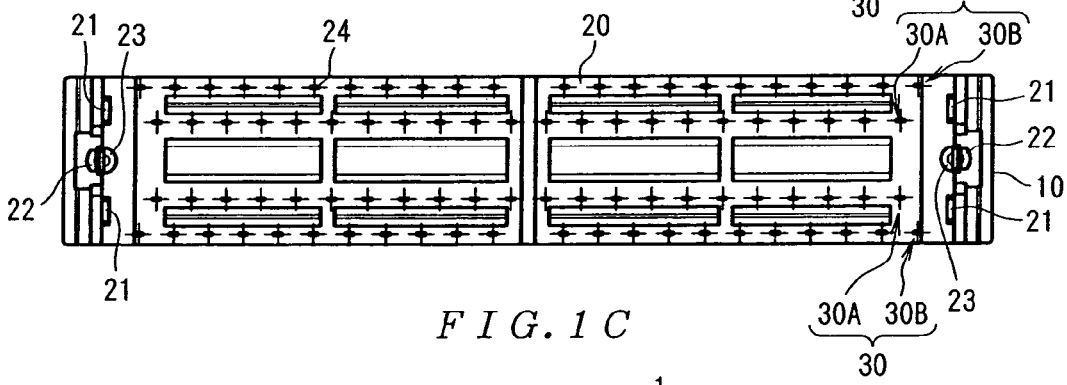
FIG. 1C is a bottom view of the floating connector.
Figure 1D:
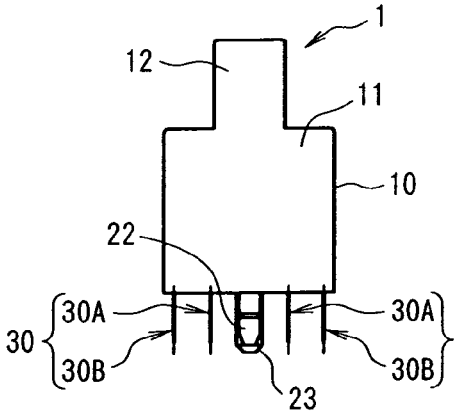
FIG. 1D is a right-side view of the floating connector.
Figure 2:
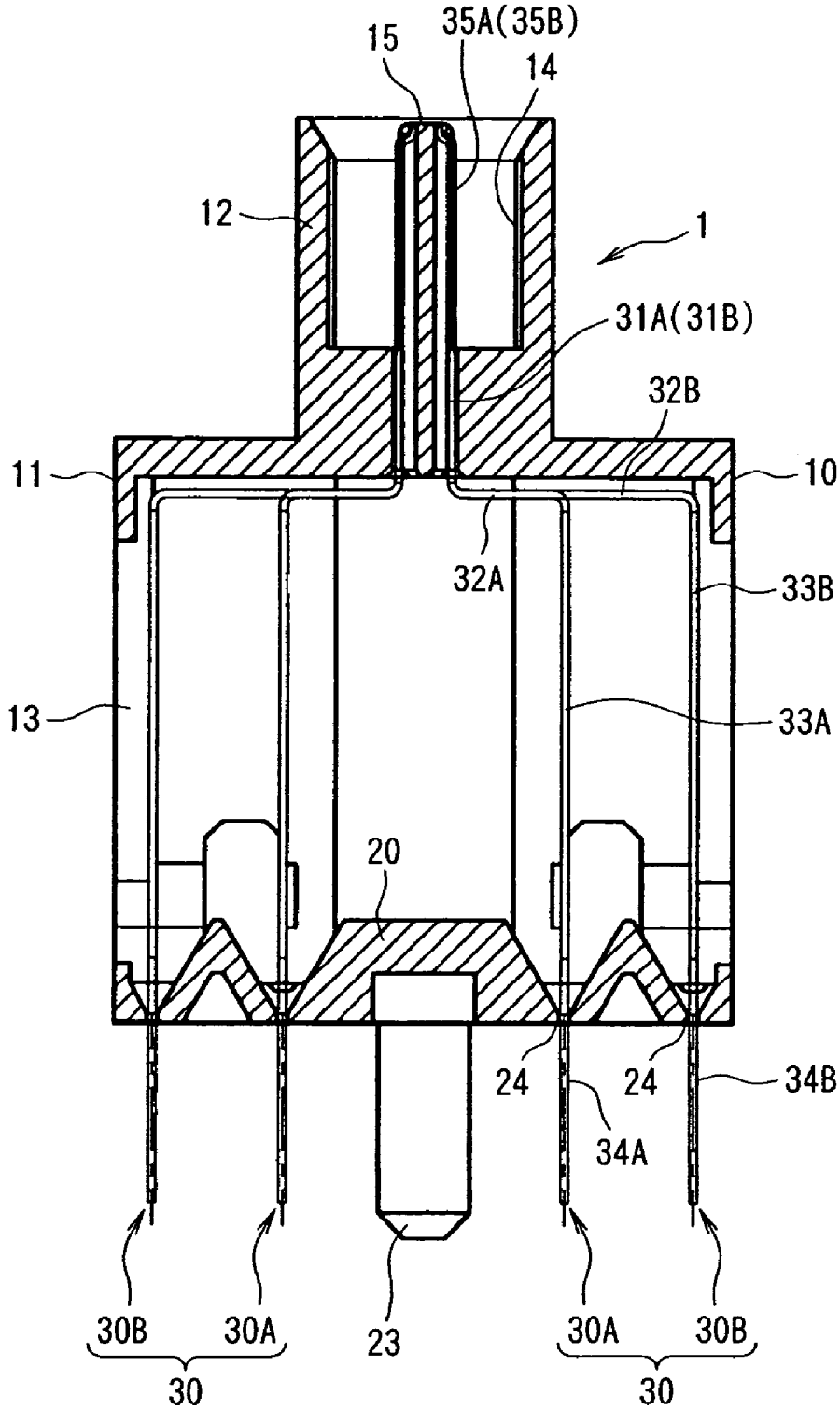
FIG. 2 is a sectional view along line 2—2 of FIG. 1B.

FIGS. 1A–1D and FIG. 2 show a floating connector 1. The floating connector 1 has an insulating housing 10 that extends in a direction of length (the left-right direction in FIG. 1B and a direction perpendicular to a plane of the page in FIG. 2. The housing 10 includes a main body 11 that extends in the direction of length. A mating member 12 protrudes upward from an upper surface of the main body 11 and extends in the direction of length. The housing 10 is formed by molding an insulating synthetic resin. As shown in FIG. 2, opening members 13 are formed in the main body 11, which open in a forward-rearward direction (left-right direction in FIG. 2) with respect to the main body 11 and in a bottom direction of the main body 11. A mating connector receiving recess 14 is formed along the direction of length in the mating member 12. Partition walls 15 protrude from a bottom member of the mating connector receiving recess 14 in a center of an interior member of the mating connector receiving recess 14. The partition walls 15 are formed to be inserted into a connector receiving recess 58 of the mating connector 50. As best shown in FIG. 1A, post receiving recesses 16, which receive guide posts 57 of the mating connector 50, are formed in both outside ends of the mating connector receiving recess 14 with respect to the direction of length.

Figure 4A:
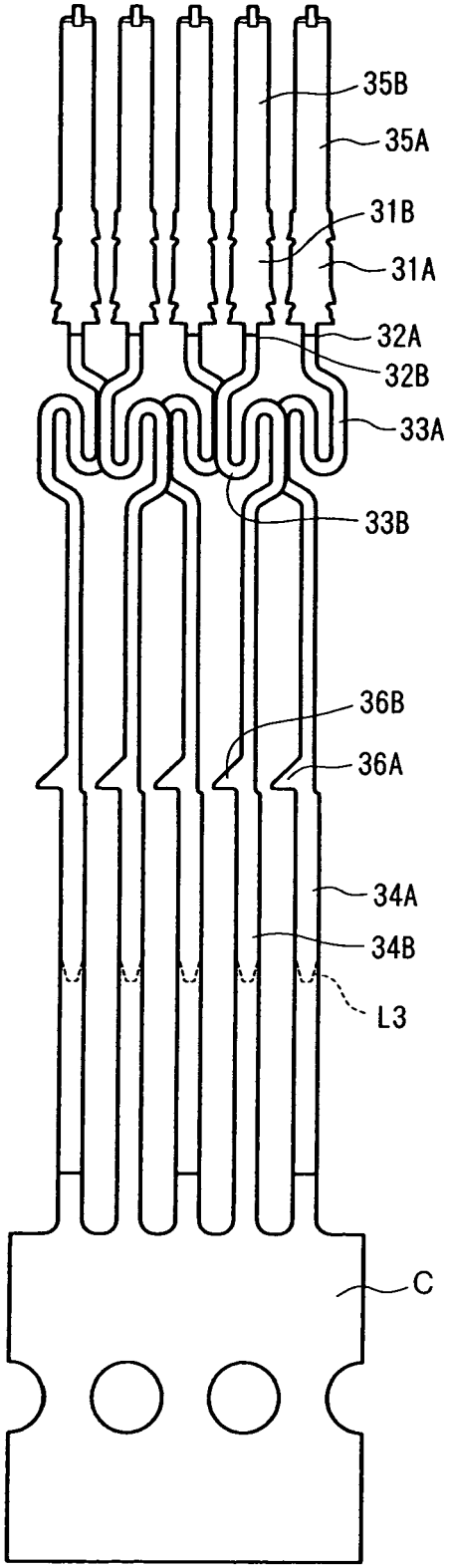
FIG. 4A is a plan view showing a first state in which forming has been applied to the plurality of contacts shown in FIG. 3.
Figure 4B:
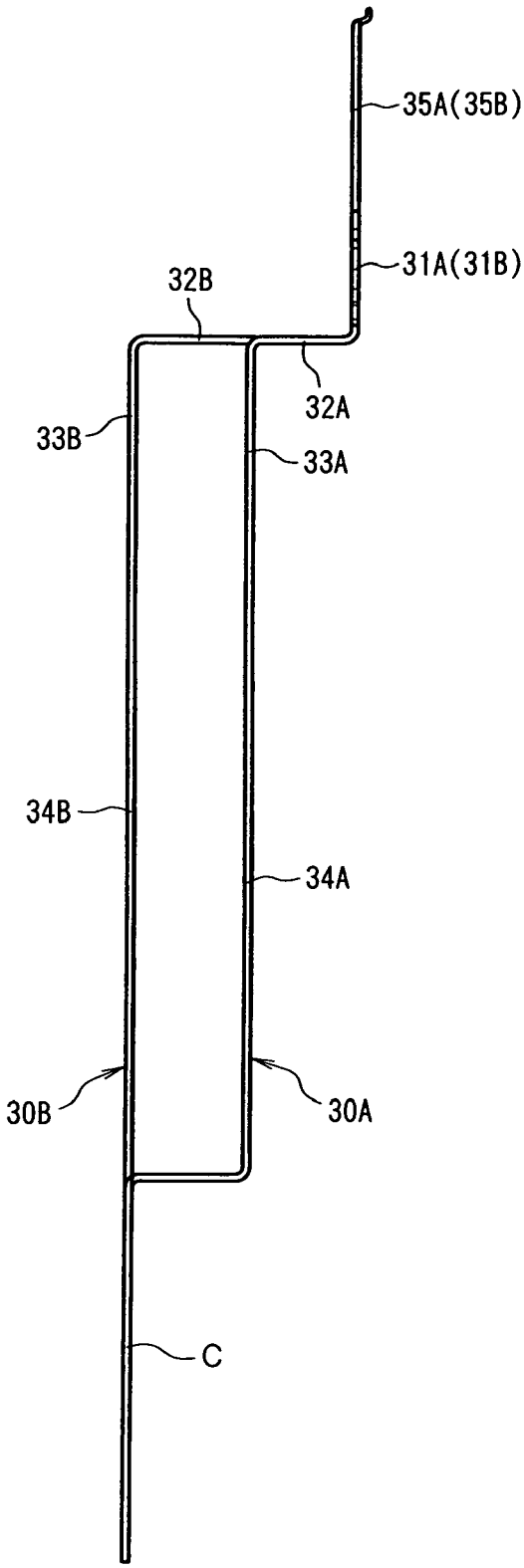
FIG. 4B is a plan view showing a second state in which forming has been applied to the plurality of contacts shown in FIG. 3.

As shown in FIGS. 1A–1D, a plurality of contacts 30 is disposed in two rows along the direction of length of the housing 10. As shown in FIG. 4B, first and second 34A, 34B legs of the contacts 30 of the respective rows are formed in a staggered configuration along the row disposition direction of the contacts 30. The contacts 30 thereby are formed to have first contacts 30A with first legs 34A disposed on an inside and second contacts 30B with second legs 34B disposed on an outside. As shown in FIGS. 1A–1D, FIG. 2, and FIGS. 4A–4B, each of the first contacts 30A has a first fastening member 31A that is fastened by press-fitting in the bottom wall of the mating member 12 of the housing 10. A first bent section 32A is bent outward from a lower end of the first fastening member 31A and has a specified length. A first elastic member 33A is bent downward from an end section of the first bent section 32A so that the first elastic member 33A is parallel to the first fastening member 31A. As best shown in FIG. 4A, the first elastic member 33A is formed with a curved shape that is substantially a reverse S shape. The first leg 34A extends downward from the first elastic member 33A. As best shown in FIG. 4A, the first leg 34A has first projections 36A formed on side portions of the first leg 34A. A first contact member 35A extends upward from the first fastening member 31A. The first contacts 30A are formed by stamping and forming metal plates.

In each of the first contacts 30A, the planes of the first fastening member 31A, the first elastic member 33A, the first leg 34A, and the first contact member 35A extend along the row disposition direction of the contacts 30 (i.e., the direction of length of the housing 10). As shown in FIG. 2, the first contact members 35A are lined up at a specified pitch on both side surfaces of the partition walls 15. The first bent sections 32A are positioned inside the corresponding opening members 13 in the main body 11 of the housing 10 when the fastening members 31 are fastened to the bottom wall of the mating member 12. The first elastic members 33A are positioned inside the opening members 13. As best shown in FIG. 4A, the elastic members 33A formed with the curved shape that is substantially a reverse S shape allows the mating member 12 to be moved elastically in the direction of length of the housing 10 and the direction perpendicular to the direction of length with respect to an upper surface of a first printed circuit board PCB1 (i.e., in the X-direction and Y-direction along the upper surface of the first printed circuit board PCB1). The first contact members 35A are set at a sufficient length so that a floating movement in a Z-direction (the direction perpendicular to the upper surface of the first printed circuit board PCB1) is possible. Since the length of the elastic members 33A and the first legs 34A extending from the end portions of the first bent sections 32A to the circuit board PCB is relatively long, elastic movement in the direction perpendicular to the direction of length of the housing 10 is possible.

The basic construction of each of the second contacts 30B is similar to that of the first contacts 30A. As shown in FIG. 4B, each of the second contacts 30B has a second fastening member 31B fastened by press-fitting to the bottom wall 12 of the mating member 12 of the housing 10. A second bent section 32B is bent outward from a lower end of the second fastening member 31B and has a specified length. A second elastic member 33B is bent downward from an end section of the second bent section 32B so that the second elastic member 33B is parallel to the second fastening member 31B. As best shown in FIG. 4A, the second elastic member 33B is formed with a curved shape that is substantially an S shape. The second leg 34B extends downward from the second elastic member 33B. A second contact member 35B extends upward from the second fastening member 31B. The length of the second bent sections 32B, however, is longer than the length of the first bent sections 32A of the first contacts 30A. As a result, the first and second legs 34A, 34B of the first and second contacts 30A, 30B are arranged in a staggered configuration in the row disposition direction of the first and second contacts 30A, 30B. The second leg 34B has second projections 36B formed on side portions of the leg 34B. The second contacts 30B are formed by stamping and forming metal plates.

In each of the second contacts 30B, the planes of the second fastening member 31B, the second elastic member 33B, the second leg 34B, and the second contact member 35B extend along the row disposition direction of the contacts 30 (i.e., the direction of length of the housing 10). As shown in FIG. 2, the second contact members 35B are lined up at a specified pitch on both side surfaces of the partition walls 15. The second bent sections 32B are disposed inside the corresponding opening members 13 in the main body 11 of the housing 10 when the second fastening members 31B are fastened to the bottom wall of the mating member 12. The second elastic members 33B are positioned inside the opening members 13 and are formed with the curved shape that is substantially an S shape, so that the second mating member 12 can be moved elastically in the direction of length of the housing 10 and the direction perpendicular to this direction of length with respect to the upper surface of the first printed circuit board PCB1. Since the length of the second elastic members 33B and the second legs 34B extending from the end portions of the second bent sections 32B to the first printed circuit board PCB1 is relatively long, elastic movement in the direction perpendicular to the direction of length of the housing 10 is possible.

Figure 6:
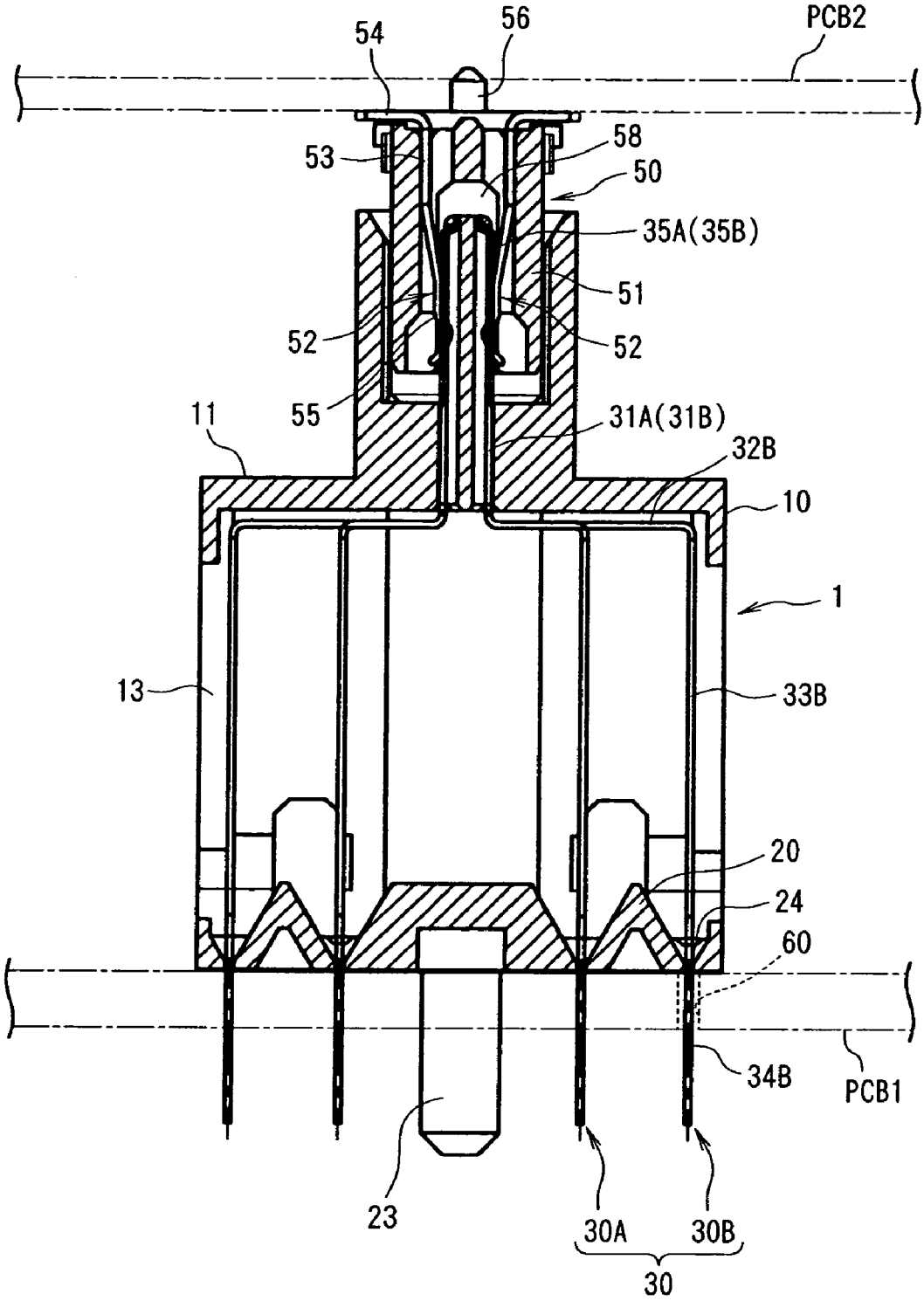
FIG. 6 is a sectional view showing a state in which the mating connector shown in FIG. 5 has been mated with the floating connector shown in FIGS. 1A–1D.
Figure 7A:
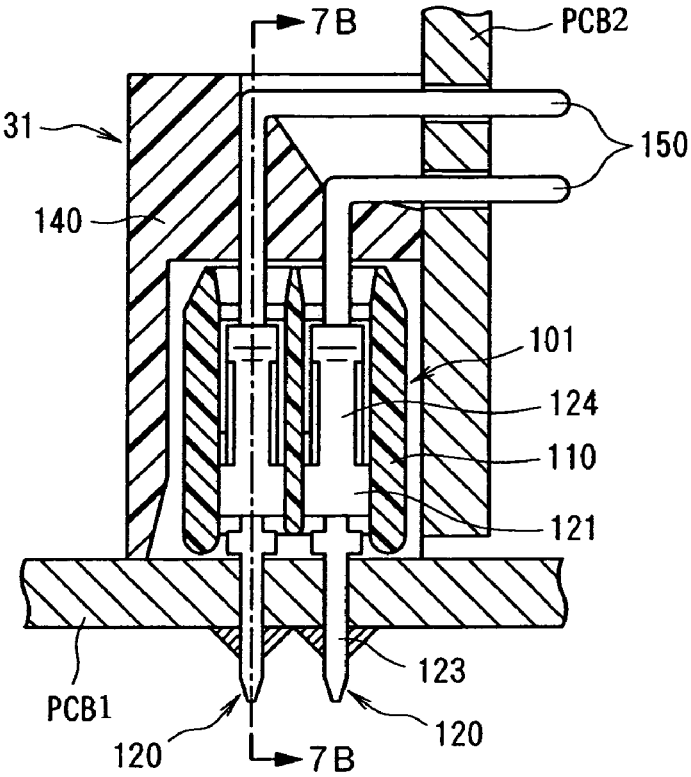
FIG. 7A Prior Art
FIG. 7A is a sectional side view of a conventional floating connector.
Figure 7B:
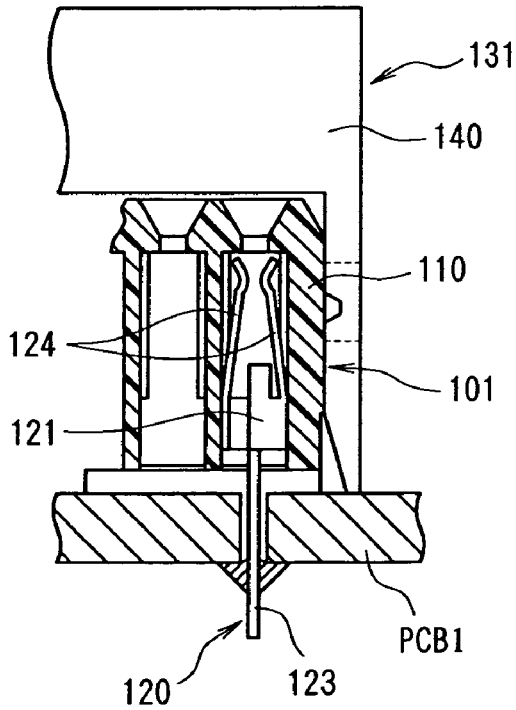
FIG. 7B Prior Art
FIG. 7B is a sectional front view of the conventional floating connector.
Figure 8A:
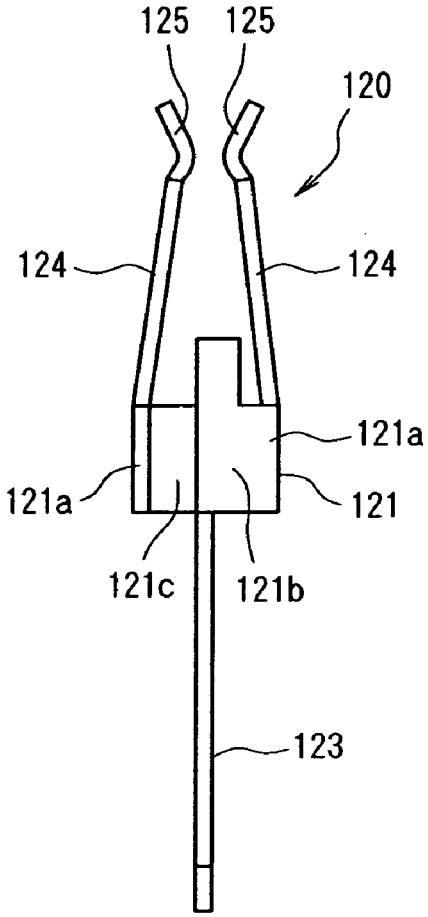
FIG. 8A Prior Art
FIG. 8A is a front view of a contact of the conventional floating connector.
Figure 8B:
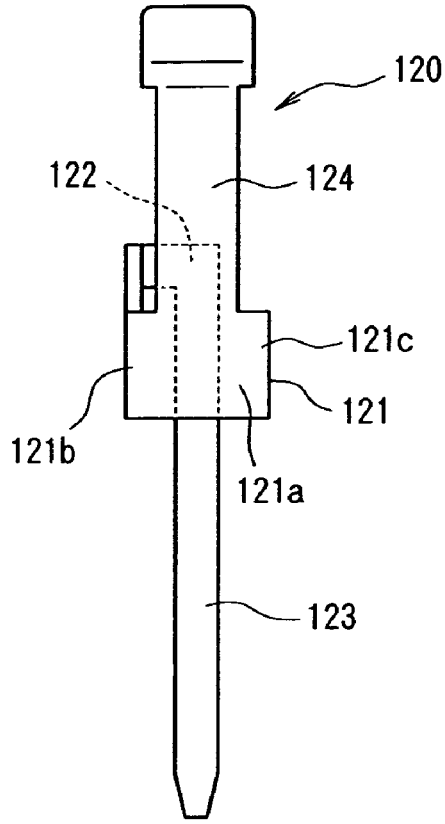
FIG. 8B Prior Art
FIG. 8B is a right side view of the contact of the conventional floating connector.
Figure 8C:
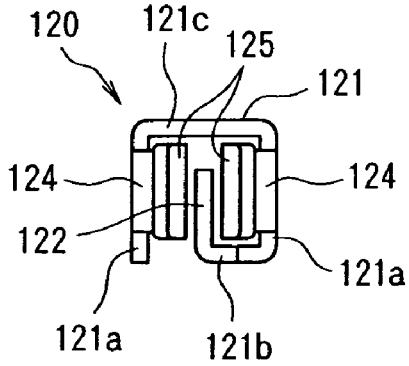
FIG. 8C Prior Art
FIG. 8C is a plan view of the contact of the conventional floating connector.
Figure 9:
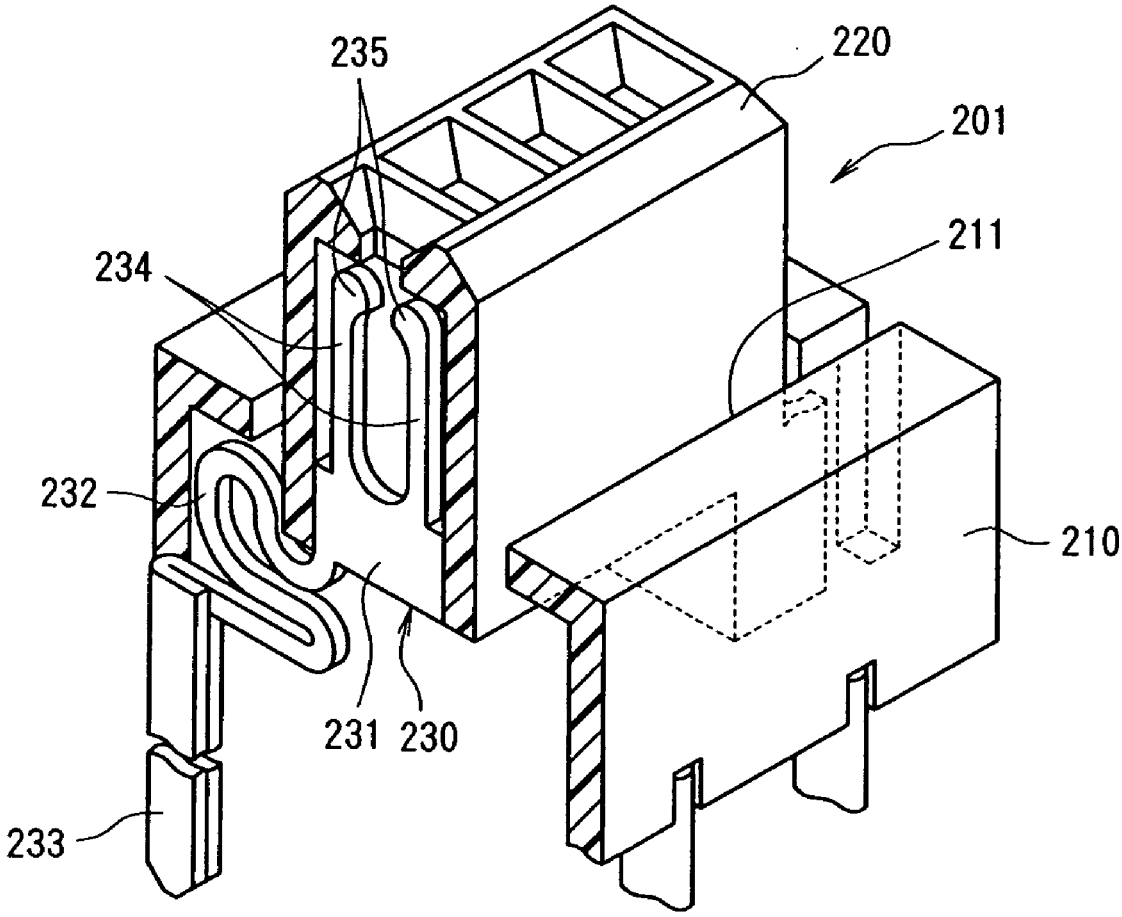
F I G. 9 Prior Art
FIG. 9 is a partial sectional perspective view of another conventional floating connector.

As shown in FIG. 6, the first and second legs 34A, 34B of the first and second contacts 30A, 30B are aligned by a tine alignment plate 20 and inserted into through-holes 60 in the first printed circuit board PCB1. As shown in FIGS. 1A–1D and FIG. 2, the tine alignment plate 20 is constructed from a substantially rectangular plate that extends in the same direction of length as the housing 10. The tine alignment plate 20 is formed by molding an insulating resin. A plurality of alignment holes 24 through which the first and second legs 34A, 34B are inserted and thus aligned are formed in the tine alignment plate 20. Housing locking members 21, which are locked to the main body 11 of the housing 10, are formed so that the housing locking members 21 protrude from both ends of an upper surface of the tine alignment plate 20 with respect to the direction of length. As best shown in FIG. 1B, board locking members 22, which are locked in the circuit board PCB1 when the floating connector 1 is mounted on the circuit board PCB1, are formed so that the board locking members 22 protrude from both ends of an undersurface of the tine alignment plate 20 with respect to the direction of length. Positioning posts 23, which are used for positioning when the floating connector 1 is mounted on the circuit board PCB1, are formed to an inside of the board locking members 22 on both ends of the undersurface of the tine alignment plate 20 with respect to the direction of length.

Figure 3:
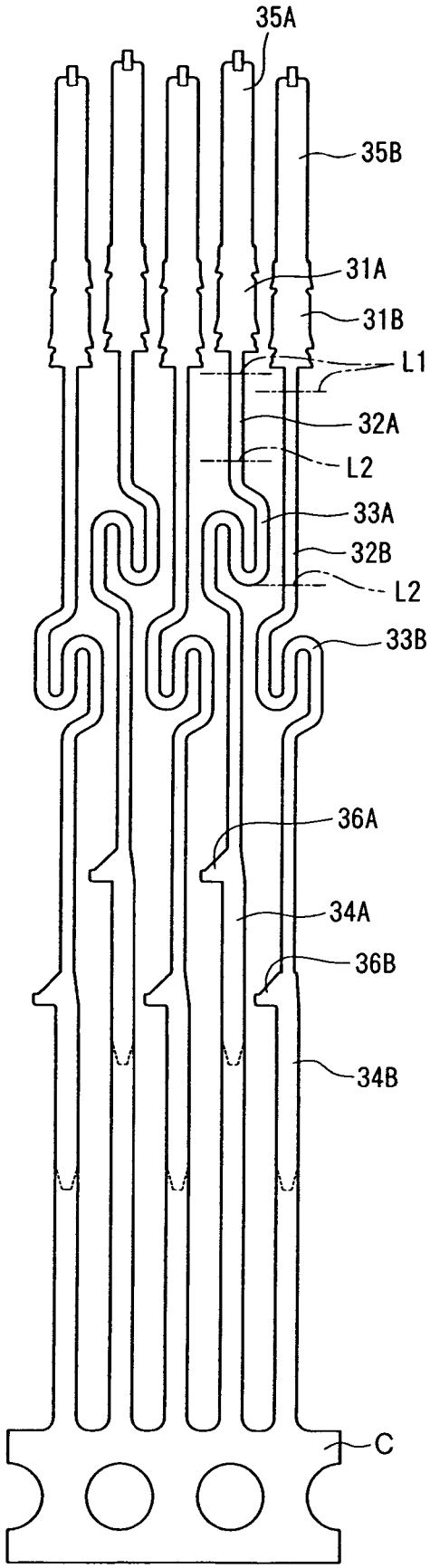
FIG. 3 is a plan view of a blank showing a state in which a plurality of contacts have been stamped.

A method for manufacturing the floating connector 1 will now be described. The housing 10 and the tine alignment plate 20 are first molded and prepared. As shown in FIG. 3, the plurality of first and second contacts 30A, 30B are stamped from metal plates. In the state in which the first and second contacts 30A, 30B are stamped from metal plates, adjacent first and second contacts 30A, 30B are connected by a shared contact carrier C on a side of the first and second legs 34A, 34B, and the first and second contacts 30A, 30B are formed in single rows. In this state of the blank, the positions of the first and second elastic members 33A, 33B of the adjacent first and second contacts 30A, 30B, the first and second fastening members 31A, 31B, the first and second legs 34A, 34B, the first and second projections 36A, 36B, and the first and second contact members 35A, 35B are shifted in an axial direction. Since the first and second elastic members 33A, 33B have the substantially inverted S shape and a substantially S shape, respectively, the first and second elastic members 33A, 33B will interfere with each other (assuming that the disposition pitch of the first and second contacts 30A, 30B is not varied) if the positions of the first and second elastic members 33A, 33B are not shifted in the axial direction in the state of the blank from which the first and second contacts 30A, 30B are punched out. As a result of the positions of the first and second elastic members 33A, 33B being shifted in the axial direction of the first and second contacts 30A, 30B so that the first and second elastic members 33A, 33B of the adjacent first and second contacts 30A, 30B do not interfere with each other, the disposition pitch of the first and second contacts 30A, 30B in the contact plate material can be reduced so that the floating connector 1 is superior in terms of the utilization of the contact material. Furthermore, as a result of the alternate disposition of the first elastic members 33A with the substantially inverted S shape and the second elastic members 33B with the substantially S shape, the die pins that stamp out the areas between the first and second elastic members 33A, 33B can be strengthened to facilitate the manufacture of the first and second contacts 30A, 30B.

After the first and second contacts 30A, 30B have been stamped from the metal plates, the first and second contacts 30A, 30B are bent along lines L1 and L2 shown in FIG. 3, so that the first and second bent sections 32A, 32B are formed between the first and second fastening members 31A, 31B and first and second elastic members 33A, 33B shown in FIGS. 4A–4B. The length of the second contacts 30B between the line L1 and the line L2 corresponds to the length of the second bent sections 32B. Since the length of the second bent sections 32B is longer than the length of the first bent sections 32A, which corresponds to the length of the first contacts 30A between the line L1 and the line L2, the second elastic members 33B and the second legs 34B are positioned further to the outside than the first elastic members 33A and the first legs 34A. Thus, the first and second legs 34A, 34B of the first and second contacts 30A, 30B in single row form are disposed in a staggered configuration along the disposition direction of the contacts 30. Since the first and second legs 34A, 34B of the contacts 30 are disposed in a staggered configuration along the disposition direction of the contacts 30, the area occupied in the direction of length of the housing 10 (i.e., the disposition direction of the contacts 30) and the direction perpendicular to the direction of length (i.e., the direction perpendicular to the disposition direction of the contacts 30) can be reduced. Accordingly, compact high-density mounting on the first printed circuit board PCB1 is possible. Additionally, because working other than the stamping of the metal plates comprises only forming that is performed once in the formation of the first and second bent sections 32A, 32B, the amount of time and work required to produce the contacts 30 is minimized.

While the contacts 30 are connected to the contact carrier C, the contacts 30 are inserted into the housing 10. Since the planes of the first and second legs 34A, 34B and the first and second contact members 35A, 35B extend in the disposition direction of the contacts 30 (i.e., in the direction of length of the housing 10), the contacts 30 can be inserted all at one time. The first and second fastening members 31A, 31B of the first and second contacts 30A, 30B are fastened by press-fitting to the bottom wall of the mating member 12.

The first and second legs 34A, 34B are cut from the contact carrier C by being cut along lines L3 shown in FIG. 4B, and the fastening of one row of the first and second contacts 30A,30B to the housing 10 is completed. Once the fastening of one row of the first and second contacts 30A, 30B has been completed, another row of the first and second contacts 30A, 30B may be fastened to the housing 10 by the previously described method. The first and second legs 34A, 34B are then passed through the alignment holes 24 of the tine alignment plate 20. As the first and second legs 34*a*, 34B are inserted, the first and second projections 36A, 36B formed on the first and second legs 34*a*, 34B ride on the tine alignment plate 20. The housing locking members 21 of the tine alignment plate 20 are locked to the housing 10 to complete the assembly of the floating connector 1.

As shown in FIG. 1B and FIG. 6, to mount the floating connector 1 to the first printed circuit board PCB1, the first and second legs 34A, 34B are passed through the through-holes 60 formed in the first printed circuit board PCB1. The positioning posts 23 of the tine alignment plate 20 are inserted into positioning holes (not shown) formed in the first printed circuit board PCB1, so that horizontal positioning of the tine alignment plate 20 with respect to the first printed circuit board PCB1 is accomplished. The board locking members 22 are locked to the first printed circuit board PCB1, so that the tine alignment plate 20 is fastened to the first printed circuit board PCB1. The first and second legs 34A, 34B are then connected by soldering to the first printed circuit board PCB1.

The floating connector 1 may be mounted on the first printed circuit board PCB1 by either manual mounting or automatic mounting. In the case of automatic mounting, there may be instances in which the positioning posts 23 and the board locking members 22 are omitted. In such a case, after the first and second legs 34A, 34B have been passed through the through-holes 60, the portions of the first and second legs 34A, 34B that are located below the first printed circuit board PCB1 are bent so that the tine alignment plate 20 and the first printed circuit board PCB1 are clamped by the first and second legs 34A, 34B and the first and second projections 36A,36B to prevent the floating connector 1 from separating from the first printed circuit board PCB1.

Figure 5:
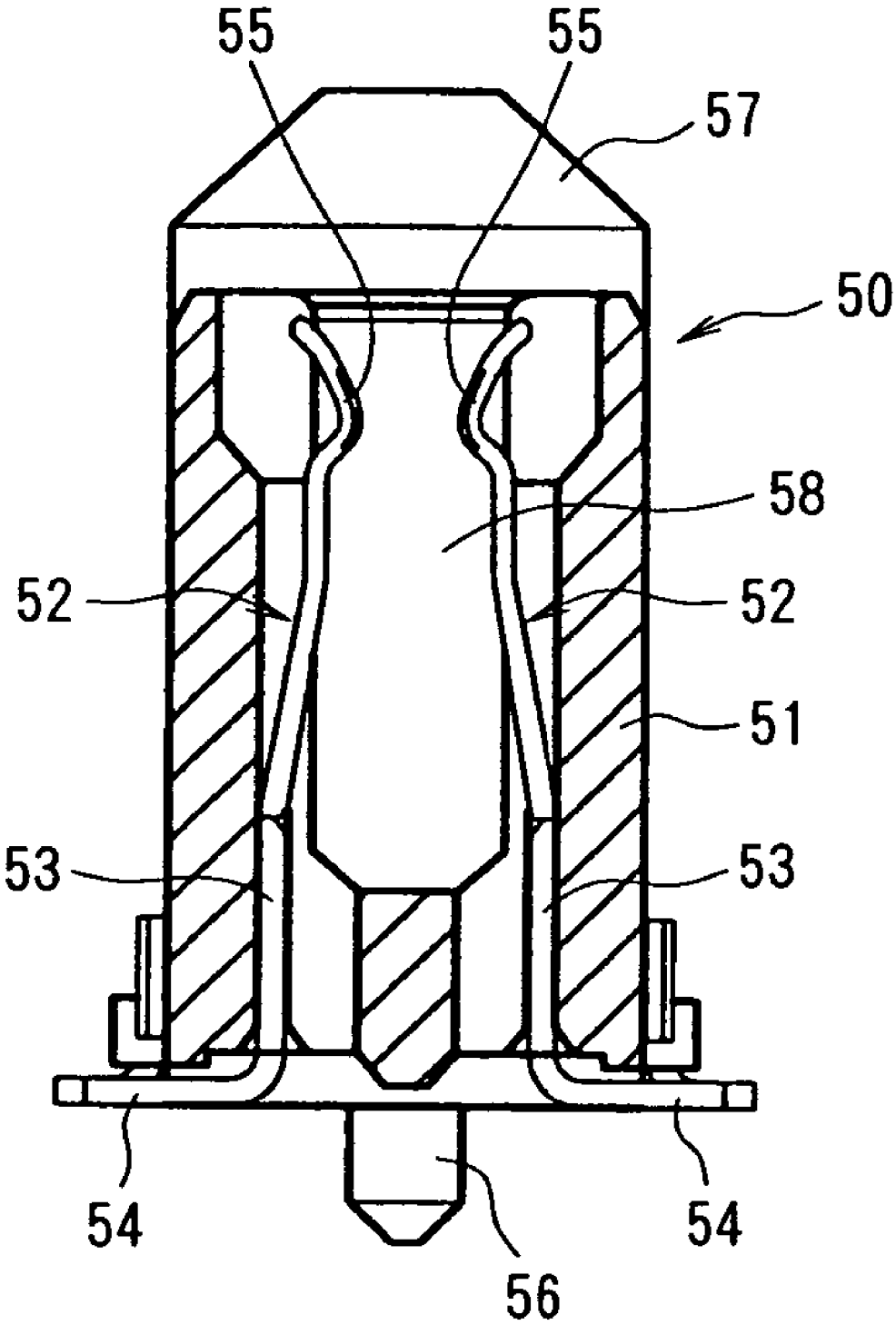
FIG. 5 is a sectional view of a mating connector.

As shown in FIG. 6, the floating connector 1 may then be mated with a mating connector 50 that is fastened to a second printed circuit board PCB2. As shown in FIG. 5, the mating connector 50 includes an insulated mating housing 51 that extends in a direction of length (i.e., a direction perpendicular to a plane of the page in FIG. 5. A plurality of mating contacts 52 are attached in two rows along the direction of length of the housing 51. A connector receiving recess 58 is formed in the mating housing 51 and extends in the direction of length. Positioning posts 56 are formed to protrude from both ends of an undersurface of the mating housing 51 with respect to the direction of length. Guide posts 57 protrude from both ends of an upper surface of the mating housing 51 with respect to the direction of length. Each of the mating contacts 52 has a fastening member 53 that is fastened to the housing 51. A board connection member 54 extends downward from a lower end of the fastening member 53 and is connected by soldering to the second printed circuit board PCB2. An elastic contact member 55 extends toward an inside of the connector receiving recess 58 from an upper end of the fastening member 53.

As shown in FIG. 6, when the mating connector 50 fastened to the second printed circuit board PCB2 is mated with the mating member 12 of the floating connector 1, the first and second contact members 35A, 35B and the elastic contact members 55 of the mating contacts 52 contact each other to electrically connect the first and second printed circuit boards PCB1, PCB2. Since the first and second elastic members 33A, 33B make it possible for the mating member 12 to move elastically in the direction of length of the housing 10 and in the direction perpendicular to the direction of length with respect to the upper surface of the first printed circuit board PCB1, strain that is created when mating the mating connector 50 with the floating connector 1 can be absorbed.

An embodiment of the invention has been described above. The present invention, however, is not limited to this embodiment. Various alterations or modifications may be made within the scope and spirit of the invention. For example, the first and second bent sections 32A, 32B may be disposed not only between the first and second fastening members 31A, 31B and the first and second elastic members 33A, 33B, but also between the first and second elastic members 33A, 33B and the first and second legs 34A, 34B.

I claim:

1. A floating connector, comprising:

an insulating housing having a plurality of first and second contacts arranged in at least one row in the housing; and each of the first and second contacts having a contact member for contacting a mating contact, a leg for connecting to a first printed circuit board, a bent section formed between the contact member and the leg, a fastening member for attachment to the housing disposed between the contact member and the bent section, and an elastic member disposed between the bent section and the leg having a curved shape and extending in a direction of the at least one row of the contacts, the bent section of the first contacts being shorter than the bent section of the second contacts so that the legs of the corresponding first and second contacts are arranged in a staggered configuration in the at least one row.

2. The floating connector of claim 1, wherein the fastening member is press-fit into the housing.

3. The floating connector of claim 1, wherein the first contacts and the second contacts are arranged such that the first contacts and the second contacts alternate in the at least one row.

4. The floating connector of claim 1, wherein the legs have a projection formed on a side surface thereof.

5. The floating connector of claim 1, wherein the legs extend parallel to the contact members.

6. The floating connector of claim 1, wherein the curved shape of the elastic member of the first contacts is a reverse S shape.

7. The floating connector of claim 6, wherein the curved shape of the elastic member of the second contacts is an S shape.

8. The floating connector of claim 1, wherein the first and second contacts are mounted on a contact carrier and are stamped and formed from a single metal plate.

9. The floating connector of claim 8, wherein the elastic members are shifted along an axial direction of the first and second contacts so that the elastic members of adjacent first and second contacts do not interfere with each other while on the contact carrier.

10. The floating connector of claim 1, further comprising a tine alignment plate for aligning the first and second contacts.

11. A method for manufacturing a floating connector, comprising the steps of:

stamping a plurality of first and second contacts from a single metal plate such that each of the first and second contacts have a contact member for contacting a mating contact, a leg for connecting to a first printed circuit board, a fastening member for attachment to a housing disposed between the contact member and the leg, and an elastic member disposed between the fastening member and the leg having a curved shape, the elastic members being shifted along an axial direction of the first and second contacts so that the elastic members of adjacent first and second contacts do not interfere with each other;

forming a bent section between the fastening member and the elastic member, the bent section of the first contacts being shorter than the bent section of the second contacts so that the legs of the corresponding first and second contacts are arranged in a staggered configuration;

inserting the first and second contacts into the housing of the floating connector simultaneously; and cutting end sections of the legs of the first and second contacts from a contact carrier.

12. The method of claim 11, wherein the fastening member is press-fit into the housing.

13. The method of claim 11, wherein the first contacts and the second contacts are arranged such that the first contacts and the second contacts alternate.

14. The method of claim 11, wherein the legs have a projection formed on a side surface thereof.

15. The method of claim 11, wherein the curved shape of the elastic member of the first contacts is a reverse S shape.

16. The method of claim 15, wherein the curved shape of the elastic member of the second contacts is an S shape.

* * * * *